US008276673B2

(12) United States Patent
Zupanick

(10) Patent No.: US 8,276,673 B2
(45) Date of Patent: Oct. 2, 2012

(54) GAS LIFT SYSTEM

(75) Inventor: Joseph A. Zupanick, Pineville, WV (US)

(73) Assignee: Pine Tree Gas, LLC, Pineville, WV (US)

( * ) Notice: Subject to any disclaimer, the term of this patent is extended or adjusted under 35 U.S.C. 154(b) by 440 days.

(21) Appl. No.: 12/404,037

(22) Filed: Mar. 13, 2009

(65) Prior Publication Data

US 2009/0229831 A1 Sep. 17, 2009

Related U.S. Application Data

(60) Provisional application No. 61/036,451, filed on Mar. 13, 2008.

(51) Int. Cl.
*E21B 43/00* (2006.01)

(52) U.S. Cl. ..... 166/372; 166/373; 166/316; 251/325

(58) Field of Classification Search ..... 166/316, 166/330, 372, 373; 175/218, 315; 251/325, 251/344

See application file for complete search history.

(56) References Cited

U.S. PATENT DOCUMENTS

| | | | |
|---|---|---|---|
| 2,810,352 | A | 10/1957 | Tumilson |
| 2,850,097 | A | 9/1958 | Bloom |
| 2,851,111 | A | 9/1958 | Jones |
| 3,135,293 | A | 6/1964 | Hulsey |
| 3,199,592 | A | 8/1965 | Jacob |
| 3,266,574 | A | 8/1966 | Gandy et at |
| 3,289,764 | A | 12/1966 | Santourian |
| 3,363,692 | A | 1/1968 | Bishop |
| 3,366,074 | A | 1/1968 | Shirley |
| 3,433,301 | A | 3/1969 | McEver, Jr. |
| 3,460,625 | A | 8/1969 | Ellis |
| 3,493,052 | A | 2/1970 | Boehm |
| 3,497,009 | A | 2/1970 | Harrington |
| 3,580,333 | A | 5/1971 | Douglas |
| 3,647,230 | A | 3/1972 | Smedley |

(Continued)

FOREIGN PATENT DOCUMENTS

CA 2313617 A1 1/2002

(Continued)

OTHER PUBLICATIONS

International Search Report and Written Opinion date mailed May 11, 2009; International PCT Application No. PCT/US09/37136.

(Continued)

*Primary Examiner* — Daniel P Stephenson
(74) *Attorney, Agent, or Firm* — Patton Boggs LLP

(57) ABSTRACT

An improved gas lift system is provided. In certain embodiments, the gas lift system includes a first tubing string and a second tubing string disposed within the first tubing string. The second tubing string is movable between a first position and a second position. Inflow of production fluids through an aperture in the first tubing string is selectively blocked when the second tubing string is in the second position. A port in the second tubing string delivers lift gas to the annulus between the first tubing string and the second tubing string. In the first position, the port is blocked to prevent fluid communication between the second tubing string and the first tubing string. In the second position, the port is uncovered to permit fluid communication between the second tubing string and the first tubing string, while a sealing member provides a seal that isolates the fluid communication from a well formation.

26 Claims, 4 Drawing Sheets

U.S. PATENT DOCUMENTS 3,678,997 A 7/1972 Barchard
3,764,235 A 10/1973 Bittermann
3,861,471 A 1/1975 Douglas
3,876,000 A 4/1975 Nutter
3,912,008 A 10/1975 Crowe
3,926,254 A 12/1975 Evans et al.
3,930,538 A 1/1976 Brennan et al.
3,937,025 A 2/1976 Alvarez-Calderon
3,971,437 A 7/1976 Clay
4,072,015 A 2/1978 Morrell et al.
4,226,284 A 10/1980 Evans
4,275,790 A 6/1981 Abercrombie
4,278,131 A 7/1981 Jani
4,295,795 A 10/1981 Gass et al.
4,372,389 A 2/1983 Hamrick et al.
4,386,654 A 6/1983 Becker
4,437,514 A 3/1984 Canalizo
4,474,409 A 10/1984 Trevits
4,573,536 A 3/1986 Lawrence
4,596,516 A 6/1986 Scott et al.
4,601,335 A 7/1986 Murahashi
4,605,067 A 8/1986 Burton, Jr.
4,625,801 A 12/1986 McLaughlin
4,643,258 A 2/1987 Kiime
4,683,945 A 8/1987 Rozsa
4,711,306 A 12/1987 Bobo
4,716,555 A 12/1987 Bodine
4,730,634 A 3/1988 Russell
4,762,176 A 8/1988 Miller
4,766,957 A 8/1988 McIntyre
4,793,417 A 12/1988 Rumbaugh
4,823,880 A 4/1989 Klatt
4,927,292 A 5/1990 Justice
4,962,812 A 10/1990 Berzin
4,990,061 A 2/1991 Fowler et al.
5,020,592 A 6/1991 Muller et al.
5,033,550 A 7/1991 Johnson et al.
5,059,064 A 10/1991 Justice
5,113,937 A 5/1992 Cholet
5,147,149 A 9/1992 Craig et al.
5,183,114 A 2/1993 Mashaw, Jr. et al.
5,186,258 A 2/1993 Wood et al.
5,201,369 A 4/1993 Berzin et al.
5,211,242 A 5/1993 Coleman et al.
5,220,829 A 6/1993 Manke et al.
5,229,017 A 7/1993 Nimerick et al.
5,311,936 A 5/1994 McNair et al.
5,333,684 A 8/1994 Walter et al.
5,411,104 A 5/1995 Stanley
5,425,416 A 6/1995 Hammeke et al.
5,431,229 A 7/1995 Christensen
5,462,116 A 10/1995 Carroll
5,479,989 A 1/1996 Shy et al.
5,482,117 A 1/1996 Kolpak et al.
5,488,993 A 2/1996 Hershberger
5,501,279 A 3/1996 Garg et al.
5,507,343 A 4/1996 Carlton et al.
5,520,248 A 5/1996 Sisson et al.
5,549,160 A 8/1996 Bownes et al.
5,582,247 A 12/1996 Brett et al.
5,588,486 A 12/1996 Heinrichs
5,605,195 A 2/1997 Eslinger et al.
5,634,522 A 6/1997 Hershberger
5,697,448 A 12/1997 Johnson
5,725,053 A 3/1998 Weber
5,799,733 A 9/1998 Ringgenberg et al.
5,809,916 A 9/1998 Strand
5,826,659 A 10/1998 Hershberger
5,857,519 A 1/1999 Bowlin et al.
5,871,051 A 2/1999 Mann
5,879,057 A 3/1999 Schwoebel et al.
5,881,814 A 3/1999 Mills
5,899,270 A 5/1999 Watson
5,941,307 A 8/1999 Tubel
6,039,121 A 3/2000 Kisman
6,089,322 A 7/2000 Kelley et al.
6,131,655 A 10/2000 Shaw
6,135,210 A 10/2000 Rivas
6,138,764 A 10/2000 Scarsdale et al.
6,148,923 A 11/2000 Casey
6,155,347 A 12/2000 Mills
6,182,751 B1 2/2001 Koshkin
6,220,358 B1 * 4/2001 Leniek, Sr. ..... 166/369
6,279,660 B1 8/2001 Hay
6,280,000 B1 8/2001 Zupanick
6,287,208 B1 9/2001 Faulkenberry et al.
6,289,990 B1 9/2001 Dillon et al.
6,302,214 B1 10/2001 Carmichael et al.
6,328,109 B1 12/2001 Pringle et al.
6,357,523 B1 3/2002 Zupanick
6,382,315 B1 5/2002 Langseth
6,382,321 B1 5/2002 Bates et al.
6,412,556 B1 7/2002 Zupanick
6,422,318 B1 7/2002 Rider
6,425,448 B1 7/2002 Zupanick et al.
6,427,785 B2 8/2002 Ward
6,439,320 B2 8/2002 Zupanick
6,454,000 B1 9/2002 Zupanick
6,478,085 B2 11/2002 Zupanick
6,497,556 B2 12/2002 Zupanick et al.
6,497,561 B2 12/2002 Skillman
6,516,879 B1 2/2003 Hershberger
6,547,011 B2 4/2003 Kilgore
6,554,069 B1 4/2003 Chatterji et al.
6,561,288 B2 5/2003 Zupanick
6,575,235 B2 6/2003 Zupanick et al.
6,585,049 B2 * 7/2003 Leniek, Sr. ..... 166/369
6,595,301 B1 7/2003 Zupanick
6,598,686 B1 7/2003 Zupanick
6,604,580 B2 8/2003 Zupanick et al.
6,604,910 B1 8/2003 Zupanick
6,623,252 B2 9/2003 Cunningham
6,629,566 B2 10/2003 Liknes
6,637,510 B2 10/2003 Lee
6,651,740 B2 11/2003 Kobylinski et al.
6,660,693 B2 12/2003 Miller et al.
6,662,870 B1 12/2003 Zupanick
6,668,918 B2 12/2003 Zupanick
6,668,925 B2 12/2003 Shaw et al.
6,668,935 B1 12/2003 McLoughlin et al.
6,672,392 B2 1/2004 Reitz
6,679,322 B1 1/2004 Zupanick
6,681,855 B2 1/2004 Zupanick et al.
6,688,388 B2 2/2004 Zupanick
6,691,781 B2 2/2004 Grant et al.
6,705,397 B2 3/2004 Hershberger
6,705,402 B2 3/2004 Proctor
6,705,404 B2 3/2004 Bosley
6,708,764 B2 3/2004 Zupanick
6,715,556 B2 4/2004 Mack et al.
6,722,452 B1 4/2004 Rial et al.
6,725,922 B2 4/2004 Zupanick
6,729,391 B2 5/2004 Hill et al.
6,732,792 B2 5/2004 Zupanick
6,769,486 B2 8/2004 Lim et al.
6,779,608 B2 8/2004 Grubb et al.
6,848,508 B2 2/2005 Zupanick
6,851,479 B1 2/2005 Zupanick et al.
6,860,921 B2 3/2005 Hopper
6,889,765 B1 5/2005 Traylor
6,932,160 B2 8/2005 Murray et al.
6,942,030 B2 9/2005 Zupanick
6,945,755 B2 9/2005 Zupanick et al.
6,945,762 B2 9/2005 Williams
6,953,088 B2 10/2005 Rial et al.
6,962,216 B2 11/2005 Zupanick
6,964,298 B2 11/2005 Zupanick
6,964,308 B1 11/2005 Zupanick
6,968,893 B2 11/2005 Rusby et al.
6,973,973 B2 12/2005 Howard et al.
6,976,533 B2 12/2005 Zupanick
6,976,547 B2 12/2005 Rial et al.
6,986,388 B2 1/2006 Zupanick et al.
6,988,548 B2 1/2006 Diamond et al.
6,988,566 B2 1/2006 Zupanick
6,991,047 B2 1/2006 Zupanick
6,991,048 B2 1/2006 Zupanick

| | | | | |
|---|---|---|---|---|
| 7,007,758 | B2 | 3/2006 | Zupanick et al. | |
| 7,025,137 | B2 | 4/2006 | Zupanick | |
| 7,025,154 | B2 | 4/2006 | Zupanick | |
| 7,036,584 | B2 | 5/2006 | Zupanick et al. | |
| 7,048,049 | B2 | 5/2006 | Zupanick | |
| 7,051,813 | B2 | 5/2006 | Hayes et al. | |
| 7,055,595 | B2 | 6/2006 | Mack et al. | |
| 7,073,594 | B2 | 7/2006 | Stegemeier et al. | |
| 7,073,595 | B2 | 7/2006 | Zupanick et al. | |
| 7,086,470 | B2 | 8/2006 | Diamond et al. | |
| 7,090,009 | B2 | 8/2006 | Zupanick | |
| 7,134,494 | B2 | 11/2006 | Zupanick et al. | |
| 7,178,611 | B2 | 2/2007 | Zupanick | |
| 7,182,157 | B2 | 2/2007 | Zupanick | |
| 7,207,395 | B2 | 4/2007 | Zupanick | |
| 7,213,644 | B1 | 5/2007 | Zupanick | |
| 7,222,670 | B2 | 5/2007 | Zupanick | |
| 7,225,872 | B2 | 6/2007 | Zupanick | |
| 7,228,914 | B2 | 6/2007 | Chavers et al. | |
| 7,243,738 | B2 | 7/2007 | Gardes | |
| 7,264,048 | B2 | 9/2007 | Zupanick et al. | |
| 7,311,150 | B2 | 12/2007 | Zupanick | |
| 7,331,392 | B2 | 2/2008 | Bosley et al. | |
| 7,353,877 | B2 | 4/2008 | Zupanick | |
| 7,360,595 | B2 | 4/2008 | Zupanick et al. | |
| 7,387,165 | B2 | 6/2008 | Lopez de Cardenas et al. | |
| 7,419,007 | B2 | 9/2008 | Belcher et al. | |
| 7,434,620 | B1 | 10/2008 | Zupanick | |
| 7,543,648 | B2 | 6/2009 | Hill et al. | |
| 7,753,115 | B2 | 7/2010 | Zupanick | |
| 7,789,157 | B2 | 9/2010 | Zupanick | |
| 7,789,158 | B2 | 9/2010 | Zupanick | |
| 7,861,008 | B2 * | 12/2010 | Batson et al. | 710/5 |
| 7,864,008 | B2 * | 1/2011 | Schilling | 335/257 |
| 2001/0010432 | A1 | 8/2001 | Zupanick | |
| 2001/0015574 | A1 | 8/2001 | Zupanick | |
| 2002/0108746 | A1 | 8/2002 | Zupanick | |
| 2002/0117297 | A1 | 8/2002 | Zupanick | |
| 2002/0134546 | A1 | 9/2002 | Zupanick | |
| 2002/0148605 | A1 | 10/2002 | Zupanick | |
| 2002/0148613 | A1 | 10/2002 | Zupanick | |
| 2002/0148647 | A1 | 10/2002 | Zupanick | |
| 2002/0153141 | A1 | 10/2002 | Hartman et al. | |
| 2002/0155003 | A1 | 10/2002 | Zupanick | |
| 2002/0189801 | A1 | 12/2002 | Zupanick | |
| 2003/0047310 | A1 | 3/2003 | Thomas | |
| 2003/0047702 | A1 * | 3/2003 | Gunnarsson et al. | 251/297 |
| 2003/0075322 | A1 | 4/2003 | Zupanick | |
| 2003/0217842 | A1 | 11/2003 | Zupanick | |
| 2004/0007353 | A1 | 1/2004 | Stave | |
| 2004/0031609 | A1 | 2/2004 | Zupanick | |
| 2004/0060705 | A1 | 4/2004 | Kelley | |
| 2004/0084183 | A1 | 5/2004 | Zupanick | |
| 2004/0108110 | A1 | 6/2004 | Zupanick | |
| 2004/0149432 | A1 | 8/2004 | Zupanick | |
| 2004/0154802 | A1 | 8/2004 | Zupanick | |
| 2004/0159436 | A1 | 8/2004 | Zupanick | |
| 2004/0206493 | A1 | 10/2004 | Zupanick | |
| 2004/0244974 | A1 | 12/2004 | Zupanick | |
| 2005/0022998 | A1 | 2/2005 | Rogers; Jr. | |
| 2005/0045333 | A1 | 3/2005 | Tessier et al. | |
| 2005/0079063 | A1 | 4/2005 | Zupanick | |
| 2005/0082065 | A1 | 4/2005 | Hayes et al. | |
| 2005/0087340 | A1 | 4/2005 | Zupanick | |
| 2005/0095156 | A1 | 5/2005 | Wolters et al. | |
| 2005/0115709 | A1 | 6/2005 | Zupanick | |
| 2005/0133219 | A1 | 6/2005 | Zupanick | |
| 2005/0163640 | A1 | 7/2005 | Sieben | |
| 2005/0167156 | A1 | 8/2005 | Zupanick | |
| 2005/0189117 | A1 | 9/2005 | Pringle et al. | |
| 2005/0211471 | A1 | 9/2005 | Zupanick | |
| 2005/0211473 | A1 | 9/2005 | Zupanick | |
| 2005/0217860 | A1 | 10/2005 | Mack et al. | |
| 2005/0257962 | A1 | 11/2005 | Zupanick | |
| 2006/0045767 | A1 | 3/2006 | Liknes | |
| 2006/0045781 | A1 | 3/2006 | Liknes | |
| 2006/0048947 | A1 | 3/2006 | Hall et al. | |
| 2006/0090906 | A1 | 5/2006 | Themig | |
| 2006/0096755 | A1 | 5/2006 | Zupanick | |
| 2006/0131029 | A1 | 6/2006 | Zupanick | |
| 2006/0266526 | A1 | 11/2006 | Ocalan et al. | |
| 2007/0199691 | A1 | 8/2007 | Heller et al. | |
| 2007/0235196 | A1 | 10/2007 | Brown et al. | |
| 2008/0060571 | A1 | 3/2008 | Zupanick | |
| 2008/0060799 | A1 | 3/2008 | Zupanick | |
| 2008/0060804 | A1 | 3/2008 | Zupanick | |
| 2008/0060805 | A1 | 3/2008 | Zupanick | |
| 2008/0060806 | A1 | 3/2008 | Zupanick | |
| 2008/0060807 | A1 | 3/2008 | Zupanick | |
| 2008/0066903 | A1 | 3/2008 | Zupanick | |
| 2008/0149349 | A1 | 6/2008 | Hiron et al. | |
| 2008/0245525 | A1 | 10/2008 | Rivas et al. | |
| 2009/0008101 | A1 | 1/2009 | Coady | |
| 2009/0032244 | A1 | 2/2009 | Zupanick | |
| 2009/0084534 | A1 | 4/2009 | Zupanick | |
| 2009/0169397 | A1 * | 7/2009 | Parr | 417/54 |
| 2009/0194291 | A1 * | 8/2009 | Fesi et al. | 166/369 |
| 2009/0266554 | A1 * | 10/2009 | Wilson et al. | 166/372 |

FOREIGN PATENT DOCUMENTS

| | | | |
|---|---|---|---|
| CA | 2350453 | A1 | 1/2002 |
| WO | WO 95/33119 | A1 | 12/1995 |
| WO | WO 98/03766 | A1 | 1/1998 |

OTHER PUBLICATIONS

Response filed Apr. 15, 2010 to Non-Final Action date mailed Apr. 15, 2010 in U.S. Appl. No. 12/184,960.

Supplemental Response filed May 6, 2010 in U.S. Appl. No. 12/184,960.

Non-Final Rejection date mailed Apr. 23, 2010 in U.S. Appl. No. 12/184,972.

Final Rejection date mailed Mar. 19, 2010 in U.S. Appl. No. 12/184,978.

Examiner Interview Summary date mailed Apr. 26, 2010 in U.S. Appl. No. 12/184,978.

RCE/Amendment filed May 6, 2010 in U.S. Appl. No. 12/184,978.

Response filed Feb. 12, 2010 to Non-Final Action dated Nov. 12, 2009 in U.S. Appl. No. 12/184,984.

Examiner Interview Summary date mailed Feb. 18, 2010 in U.S. Appl. No. 12/184,984.

Response filed Apr. 15, 2010 to Non-Final Action date mailed Jan. 15, 2010 in U.S. Appl. No. 12/184,988.

Examiner Interview Summary date mailed Apr. 16, 2010 in U.S. Appl. No. 12/184,988.

Notice of Allowance mailed Mar. 9, 2011 for U.S. Appl. No. 12/184,965.

Notice of Allowance mailed Feb. 28, 2011 for U.S. Appl. No. 12/184,972.

Non-final Rejection mailed Jan. 6, 2011 for U.S. Appl. No. 12/834,717.

Non-final Rejection mailed Oct. 27, 2010 for U.S. Appl. No. 12/184,984.

Response after non-final office action filed Jan. 27, 2011 for U.S. Appl. No. 12/184,984.

Non-final Rejection mailed Dec. 27, 2010 for U.S. Appl. No. 12/872,958.

Response after non-final office action filed Mar. 30, 2011 for U.S. Appl. No. 12/872,958.

Non-final Rejection mailed Dec. 8, 2010 for U.S. Appl. No. 12/872,920.

Non-Final Action date mailed May 25, 2010 in U.S. Appl. No. 12/184,965.

Notice of Allowance date mailed Jun. 2, 2010 in U.S. Appl. No. 12/184,960.

Non-Final Office Action date mailed Jan. 15, 2010 for U.S. Appl. No. 12/184,960.

Non-Final Office Action date mailed Sep. 28, 2009 for U.S. Appl. No. 12/184,978.

Response filed Dec. 28, 2009 to Non-Final Office Action date mailed Sep. 28, 2009 for U.S. Appl. No. 12/184,978.

Interview Summary date mailed Dec. 29, 2009 for U.S. Appl. No. 12/184,978.

Non-Final Office Action date mailed Nov. 12, 2009 for U.S. Appl. No. 12/184,984.
Non-Final Office Action date mailed Jan. 15, 2010 for U.S. Appl. No. 12/184,988.
Non-Final Office Action date mailed May 12, 2010 in U.S. Appl. No. 12/184,984.
Notice of Allowance date mailed May 13, 2010 in U.S. Appl. No. 12/184,988.
Notice of Allowance date mailed Jun. 29, 2010 in U.S. Appl. No. 12/184,978.
International Search Report and Written Opinion date mailed Dec. 29, 2008; International Patent Application No. PCT/US2008/072012.
Hutlas, et al "A Practical Approach to Removing Gas Well Liquids", Journal of Petroleum Technology, vol. 24, No. 8, Aug. 1972, pp. 916-922.
Restriction Requirement dated May 11, 2009 for U.S. Appl. No. 12/184,978.
Response filed Jun. 10, 2009 to Restriction Requirement dated May 11, 2009 for U.S. Appl. No. 12/184,978.
Response to non-final office action filed Aug. 25, 2010 for U.S. Appl. No. 12/184,965.
Response to non-final office action filed Jul. 23, 2010 for U.S. Appl. No. 12/184,972.
Final office action date mailed Sep. 10, 2010 for U.S. Appl. No. 12/184,972.
Non-Final Office Action date mailed Nov. 24, 2010 for U.S. Appl. No. 12/184,965.
Amendment after Final filed Nov. 10, 2010 for U.S. Appl. No. 12/184,972.
Advisory Action date mailed Nov. 19, 2010 for U.S. Appl. No. 12/184,972.
Amendment after Final filed Nov. 19, 2010 for U.S. Appl. No. 12/184,972.
Non-Final Office Action date mailed Oct. 27, 2010 for U.S. Appl. No. 12/184,984.
Final Rejection mailed Jun. 24, 2011 for U.S. Appl. No. 12/834,717.
Response After Final Rejection and Terminal Disclaimer filed Aug. 15, 2011 for U.S. Appl. No. 12/872,958.
Examiner's Interview Summary Record mailed Aug. 15, 2011 for U.S. Appl. No. 12/872,958.
Terminal Disclaimer Review Decision mailed on Aug. 23, 2011 for U.S. Appl. No. 12/872,958.
Applicant-Initiated Interview Summary and Advisory Action Before the Filing of an Appeal Brief mailed Sep. 1, 2011 for U.S. Appl. No. 12/872,958.
Amendment after Final Rejection and Terminal Disclaimer Re-filed Sep. 15, 2011 for U.S. Appl. No. 12/872,958.
Supplemental Amendment filed Sep. 15, 2011 for U.S. Appl. No. 12/872,958.
Final Rejection mailed Jul. 6, 2011 for U.S. Appl. No. 12/872,920.
Interview Summary issued Sep. 16, 2011 for U.S. Appl. No. 12/404,037.
Amendment After Final filed Oct. 24, 2011 for U.S. Appl. No. 12/834,717.
Non-Final Rejection mailed Nov. 9, 2011 for U.S. Appl. No. 12/834,717.
Amendment after Final Rejection filed Oct. 6, 2011 for U.S. Appl. No. 12/872,920.
Applicant Initiated Interview Summary mailed Oct. 13, 2011 for U.S. Appl. No. 12/872,920.
Advisory Action mailed Oct. 21, 2011 for U.S. Appl. No. 12/872,920.
Resquest for Continued Examination (RCE) filed Dec. 15, 2011 for U.S. Appl. No. 12/872,958.
Terminal Disclaimer Review Decision mailed on Dec. 16, 2011 for U.S. Appl. No. 12/872,958.
Notice of Allowance mailed Jan. 9, 2012 for U.S. Appl. No. 12/872,958.
Request for Continued Examination (RCE) filed Jan. 6, 2012 for U.S. Appl. No. 12/872,920.

* cited by examiner

GAS LIFT SYSTEM

CROSS-REFERENCE TO RELATED APPLICATIONS

This application claims the benefit of U.S. Provisional Application No. 61/036,451, filed Mar. 13, 2008, which is hereby incorporated by reference.

BACKGROUND

1. Field of the Invention

The invention relates generally to the recovery of subterranean deposits and more specifically to systems and methods for controlling and removing fluids in a well.

2. Description of Related Art

Oil and gas wells frequently require artificial lift processes to remove liquids from the wells. Gas lift systems are a type of artificial lift that typically operate by injecting pressurized gas near the base of the accumulated fluid level to force the liquid to the surface. Problems can occur, however, if gas lift operations are used in horizontal wells or in wells with low-pressure formations. In these instances, the injected gas can flow downhole or into the producing formation, either of which causes inefficient use of the lift gas and further impedes oil and/or gas production.

SUMMARY

The problems presented in removing liquid from a gas-producing well are solved by the systems and methods of the illustrative embodiments illustrated herein. In one embodiment, a gas lift system for removing liquid from a wellbore includes a first tubing string positioned within the wellbore and a second tubing string disposed within the first tubing string. The second tubing string is movable between a first position and a second position, and an annulus is present between the second tubing string and the first tubing string. An aperture is positioned in the first tubing string. A sleeve is slidingly disposed around a portion of the second tubing string, and a port is disposed in a wall of the second tubing string. The port is substantially covered by the sleeve in the first position and is substantially uncovered in the second position to permit fluid communication between an inner passage of the second tubing string and the annulus. A sealing member is operatively associated with the aperture to allow fluid communication between the wellbore and the annulus when the second tubing string is in the first position. The sealing member substantially inhibits fluid communication through the aperture when the second tubing string is in the second position.

In another embodiment, a gas lift system for removing liquid from a wellbore includes a first tubing positioned within the wellbore and a second tubing string disposed within the first tubing string. The first tubing string is fluidly connected to a separator, and the second tubing string is operatively connected to a lifting device to move the second tubing string between a first position and a second position. The second tubing string includes an inner passage fluidly connected to an outlet of a compressor. An aperture is positioned near an end of the first tubing string, the aperture being adapted to receive an end of the second tubing string in the second position. A first flange is disposed on the second tubing string, and a second flange is disposed on the second tubing string. A sleeve is slidingly disposed around the second tubing string between the first flange and the second flange within the first tubing string. An outlet is disposed in a wall of the second tubing string such that the outlet is closed by the sleeve in the first position and is open in the second position to permit fluid communication between the inner passage of the second tubing string and a first annulus between the first tubing string and the second tubing string. A sealing member is provided to create a seal between the aperture in the first tubing string and the end of the second tubing string in the second position.

In still another embodiment, a gas lift system for removing liquid from a wellbore is provided and includes a first tubing string positioned within the wellbore and a second tubing string disposed within the first tubing string. The second tubing string is rotatable between a first position and a second position. An aperture in the first tubing string is adapted to receive an end of the second tubing string in the second position. A sealing member is provided for creating a seal between the aperture in the first tubing string and the end of the second tubing string in the second position. A first port is positioned on the second tubing string in fluid communication with a first inner passage of the second tubing string. A second port is positioned on the second tubing string in fluid communication with the first inner passage of the second tubing string. The first and second ports are disposed on opposite sides of the sealed aperture and are substantially open when the second tubing string is positioned in the first position. At least one of the first and second ports is substantially blocked when the second tubing string is in the second position. A third port is positioned on the second tubing string in fluid communication with a second inner passage of the second tubing string. The third port is substantially blocked when the second tubing string is in the first position and is substantially open when the second tubing string is in the second position.

In yet another embodiment, a gas lift system for removing liquid from a wellbore includes a first tubing string positioned within the wellbore and a second tubing string disposed within the first tubing string. The second tubing string includes an inner passage and is movable between a first position and a second position. An annulus is present between the second tubing string and the first tubing string. An aperture is disposed in the first tubing string to permit fluid communication between the wellbore and the annulus when the second tubing string is in the first position. A port is disposed in the second tubing string to permit fluid communication between the inner passage and the annulus when the second tubing string is in the second position.

In another embodiment, a gas lift system for removing liquid from a wellbore includes a first tubing string positioned with the wellbore and a second tubing string disposed within the first tubing string. The second tubing string is movable between a first position and a second position. The system further includes a downhole valve actuated by movement of the second tubing string to allow a lift gas to flow from one of the first and second tubing strings to another of the first and second tubing strings.

In still another embodiment, a gas lift system for removing liquid from a wellbore is provided and includes a first tubing string positioned with the wellbore and a second tubing string disposed within the first tubing string. The second tubing string is movable between a first position and a second position. The system further includes a downhole valve actuated by movement of the second tubing string to isolate the first and second tubing strings from the wellbore during operation of a gas lift process.

In yet another embodiment, a gas lift system for removing liquid from a wellbore includes a first tubing string positioned in a wellbore and having a selectively closable downhole end.

A second tubing string is positioned within the first tubing string, and the second tubing string is fluidly connected to a source of pressurized gas. A sleeve is disposed around the second tubing string and is movable relative to the second tubing string to selectively open or close an outlet of the second tubing string.

In another embodiment, a method for removing liquid from a wellbore of a well includes positioning a first tubing string in the wellbore and positioning a second tubing string within the first tubing string. The second tubing string is moved into a removal position to (1) isolate an annulus between the first tubing string and the second tubing string from a formation of the well, and (2) inject gas from the second tubing string into the annulus. The second tubing string is moved into a production position to allow production of production fluid from the formation through the annulus.

Other objects, features, and advantages of the invention will become apparent with reference to the drawings, detailed description, and claims that follow.

DETAILED DESCRIPTION OF ILLUSTRATIVE EMBODIMENTS

In the following detailed description of the illustrative embodiments, reference is made to the accompanying drawings that form a part hereof, and in which is shown by way of illustration specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the illustrative embodiments is defined only by the appended claims.

Figure 1:
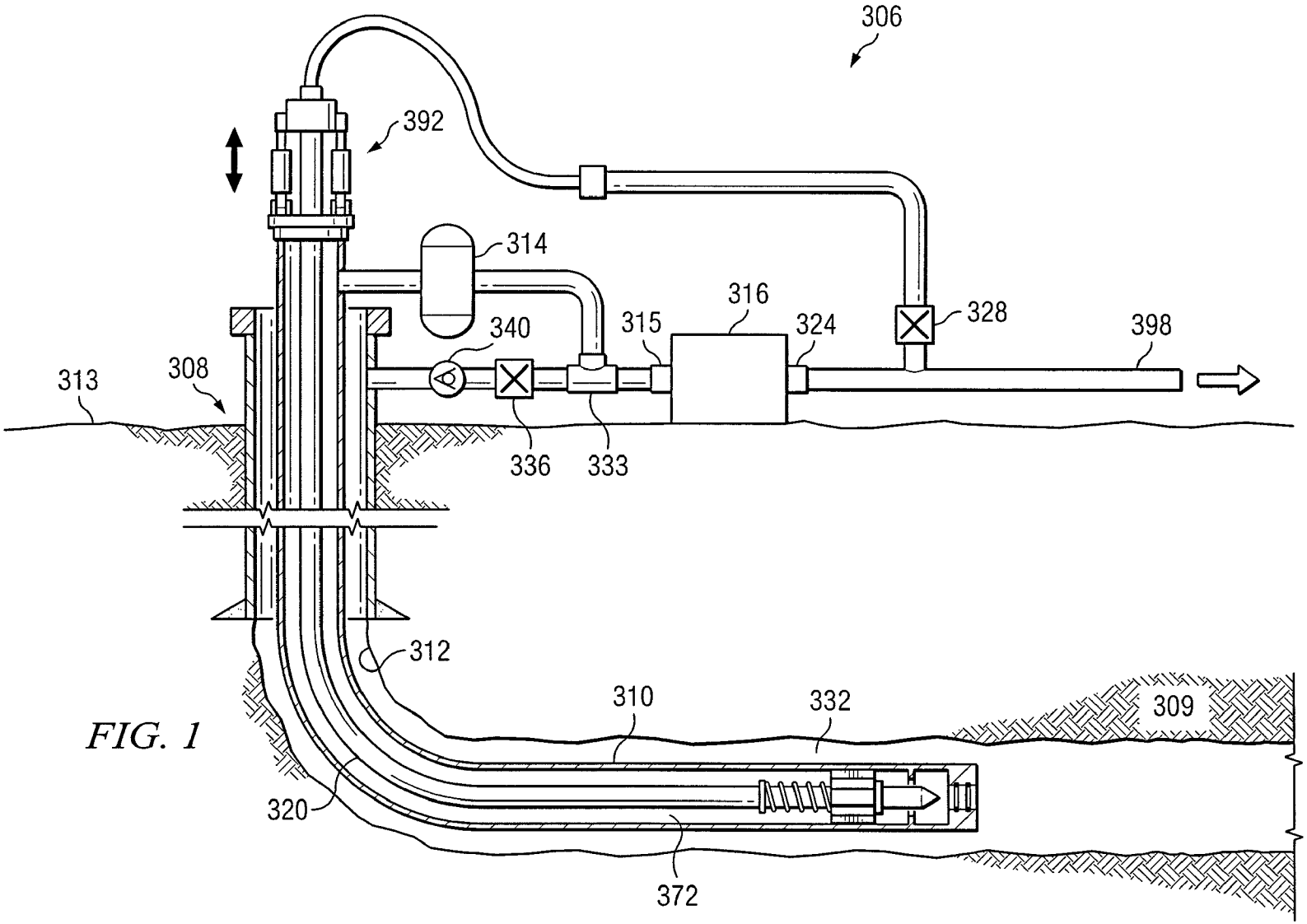
FIG. 1 illustrates a front schematic view of a gas lift system according to an illustrative embodiment.

Referring to FIG. 1, an improved gas lift system 306 according to an illustrative embodiment is used in a well 308 that may have at least one substantially horizontal portion for producing gas, coalbed methane, oil, or other subterranean deposits from a formation 309. The gas lift system 306 includes a first tubing string 310 disposed within a wellbore 312 of the well 308 that extends from a surface 313 of the well 308 to a downhole location within the wellbore 312. At or near the surface 313, the first tubing string 310 is fluidly connected to a separator 314, which is in turn fluidly connected to an inlet 315 of the compressor 316. The first tubing string 310 acts as a fluid conduit for fluid removed from the wellbore 312. Since the fluid is removed through a gas lift operation, as described in more detail below, the removal process delivers a mixture of gas and liquid to the separator 314, which separates the liquid from the gas. The gas may be returned to the compressor 316, which is used to drive the gas lift operation. Although a compressor is described as receiving low pressure gas from the well and boosting the pressure so as to provide high pressure discharge gas used in the gas lift process, other configurations are also envisioned. For example, gas may flow directly from the wellbore 312 to a sales line 398 without the use of a dedicated compressor 316. In such a case, a separate high pressure source would provide the necessary lift gas. Similarly, if the well produces little gas, such as might be the case in an oil well, off-site lift gas may be piped to the well. Alternatively, compressed air may be used as the lift-gas, eliminating any value of capture and re-use of such lift gas.

A second tubing string 320 is positioned within the first tubing string 310 and extends downhole from the surface 313 of the well 308. The second tubing string 320 is fluidly connected to an outlet 324 of the compressor 316 and may remain constantly charged with discharge pressure. Optionally, a valve 328 may be positioned between the outlet 324 and the second tubing string 320 to selectively control introduction of compressed gas to the second tubing string 320 during gas lift operations. During gas lift operations, gas from the compressor 316 flows through second tubing string 320 to lift accumulated liquids from the well through the annulus between the first tubing string 310 and the second tubing string 320. Although not expressly described, it is well understood that gas lift processes are flexible with respect to injection and discharge conduits. As such, lift gas could be injected through the annulus of first tubing string 310 and second tubing string 320, and produced liquids could return up the second tubing string 320.

An annulus 332 is present between the first tubing string 310 and the wellbore 312 through which gas may be produced during certain operational modes of the well 308, which are described in more detail below. The annulus 332 is fluidly connected at or near the surface 313 to the inlet 315 of the compressor 316. As previously described, the first tubing string 310 is also fluidly connected (through the separator 314) to the inlet 315 of the compressor 316. A three-way connector 333 is provided to fluidly connect both the first tubing string 310 and the annulus 332 to the inlet 315. A valve 336 is positioned between the annulus 332 and the compressor inlet 315 to selectively allow or prevent fluid flow depending on the operational mode of the well. A check valve 340 is also provided to prevent flow of fluids from the first tubing string 310 into the annulus 332.

Figure 2:
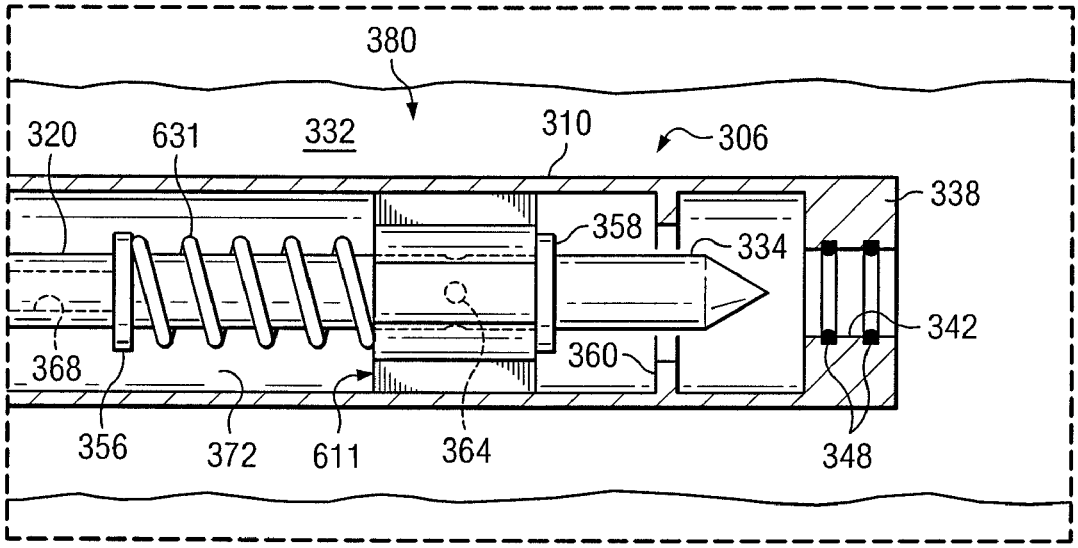
FIG. 2 depicts a front schematic view of a valve mechanism that may be used with the gas lift system of FIG. 1 according to an illustrative embodiment, the valve mechanism including a second tubing string positioned in a retracted position.
Figure 3:
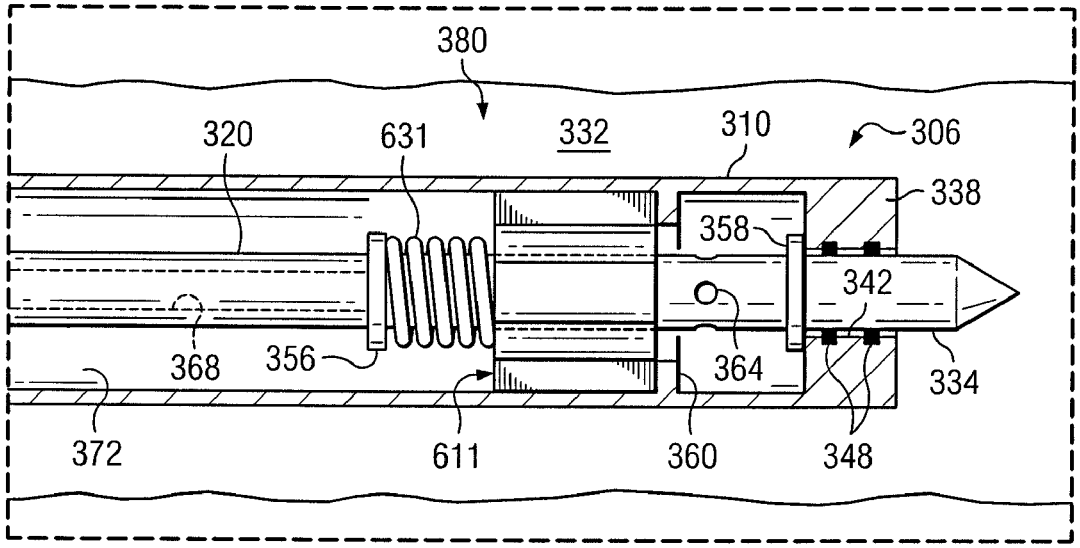
FIG. 3 illustrates the valve mechanism of FIG. 2 with the second tubing string in an extended position.

Referring to FIGS. 2 and 3, the second tubing string 320 preferably terminates in a sealed, downhole end 334. The first tubing string 310 may include an end cap 338 with an aperture 342 passing through the end cap 338. The aperture 342 is adapted to receive the downhole end 334 of the second tubing string 320, and sealing members 348 such as o-rings are positioned within the aperture 342 or on the sealed end 334 to create a sealing engagement between the end cap 338 and the second tubing string 320.

A first flange 356 and a second flange 358 are disposed on the second tubing string 320 uphole of the end cap, and a shoulder 360 is disposed on an inner wall of the first tubing string 310. An aperture or plurality of apertures, or ports 364 communicate with an inner passage 368 of the second tubing string 320 to deliver lift gas from the compressor 316, through the second tubing string 320 to an annulus 372 between the first tubing string 310 and the second tubing string 320.

Figure 4:
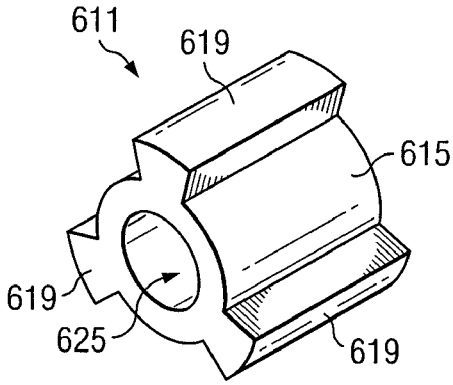
FIG. 4 depicts a sleeve of the valve mechanism of FIGS. 2 and 3.

Referring still to FIGS. 2 and 3, but also to FIG. 4, a sleeve 611 is slidingly disposed on the second tubing string 320 between the first flange 356 and the second flange 358, thus forming a sliding valve mechanism that exposes or covers the plurality of ports 364 on the second tubing string 320. In one embodiment, the sleeve 611 may be movable within the first tubing string 310, while in another embodiment the sleeve 611 may be rigidly fixed to the first tubing string 310. The sleeve 611 includes a substantially cylindrical central portion 615 and a plurality of extension portions 619 extending radially outward from an outer surface of the central portion 615. The extension portions 619 serve to centralize the second tubing, while providing a flow path to fluids traveling past the sleeve 611. The central portion 615 of the sleeve includes a passage 625 that receives the second tubing string 320. In one embodiment, the sleeve 611 is integrally formed from a single piece of material, although the components of the sleeve 611 could be individually fabricated and then welded, joined, bonded, or otherwise attached.

In certain embodiments, a spring member 631 is operatively engaged with the second tubing string 320. In one embodiment, the spring member 631 is positioned between the sleeve 611 and the first flange 356 to bias the sleeve 611 toward the second flange 358 when the spring member 631 is in an uncompressed position (see FIG. 2). The spring member 631 is capable of being in the uncompressed position when the second tubing string 320 has been retracted into a retracted, or production position (see FIG. 2). In the retracted position, the downhole end 334 of the second tubing string 320 is disengaged from the aperture 342 of the end cap 338, which results in free passage of fluids between the annulus 372 and the wellbore 312. When the spring is in the uncompressed position, the passage 625 of the sleeve 611 covers the plurality of ports 364 on the second tubing string 320. Sealing members such as elastomeric o-rings (not shown) positioned within the passage 625 or disposed on the second tubing string 320 adjacent the ports 364 provide a sealing connection between the sleeve 611 and the second tubing string 320 thus preventing exhaust of gas from the second tubing string 320 into the annulus 372. Alternatively, the sleeve 611 may itself be formed of elastomeric material with an interference fit between second tubing string 320 so as to provide the necessary sealing connection.

In the embodiment described above, the spring member 631 may be placed in a compressed position (see FIG. 3) by extending the second tubing string 320 into an extended, or removal position (see FIG. 3). As the second tubing string 320 moves into the extended position, the sleeve 611 abuts the shoulder 360 of the first tubing string 310 which causes the spring member 631 to compress as the second tubing string 320 continues to extend. In the extended position illustrated in FIG. 3, the spring member 631 is substantially compressed, and the sleeve 631 has traveled uphole relative to the second tubing string 320, which permits pressurized gas within the second tubing string 320 to exhaust into the annulus 372. Additionally, in the extended position, the downhole end 334 of the second tubing string 320 may fully engage the aperture 342 of the end cap 338, which results in sealing engagement between the end cap 338 and the second tubing string 320. This sealing engagement prevents pressurized gas in the annulus 372 from exhausting through the aperture 342, thus forming an isolated chamber for gas lifting the liquids to the surface. In one embodiment, a fully extended position is reached when the second flange 358 of the second tubing string 320 abuts the end cap 338. In another embodiment, a fully extended position may be reached when the sleeve 631 abuts the shoulder 360 and the spring member 631 becomes fully compressed.

Together, the first tubing string 310, the second tubing string 320, and the sleeve 611 act as a downhole valve 380 that selectively controls two fluid flow paths based on axial movements of the second tubing string 320.

Referring again to FIG. 1, but still to FIGS. 2-4, a lifting device 392 is provided at or near the surface 313 and is cooperative with the second tubing string 320 to lift and lower the second tubing string 320. Lifting of the second tubing string 320 moves the second tubing string into the retracted position. Lowering of the second tubing string 320 moves the second tubing string into the extended position. In a preferred embodiment, the lifting device 392 at the wellhead would use the lift gas as a source of motive pressure. Alternatively, the lifting device 392 may be hydraulically, pneumatically, mechanically, or electrically driven. The lifting device may also be placed down-hole of the surface wellhead assembly.

In the illustrative embodiments described herein, the gas lift system 306 allows a gas-lift, fluid-removal operation in which the point of gas injection (i.e. ports 364) is positively isolated and blocked from communication with the well formation 309. This positive sealing process is especially advantageous in horizontal wells, where an alternative isolation device, such as a gravity operated check valve, may not perform adequately. Additionally, because the point of gas lift injection is selectively isolated within a separate tubing string (i.e. first tubing string 310), normal production of the formation 309 may continue uninterrupted during the gas-lift, fluid removal operation.

In operation, the well 308 may be operated in one of at least two modes: a "normal production" mode and a "blow down" mode. In the normal production mode, the second tubing string 320 is lifted by the lifting device 392 into the retracted position. Additionally, the valve 336 is positioned in a closed position to prevent fluid flow to compressor 316 through annulus 332. Since the retracted positioning of the second tubing string 320 (i) unseals the end cap 338 and (ii) prevents pressurized gas from the second tubing string from entering the annulus 372, normal production of gas from the formation 309 is allowed to proceed through the annulus 372 into the separator 314 and into the compressor 316. At the compressor 316, the gas may be pressurized for delivery to a production conduit 398 for sale of the gas. A portion of the gas exiting the compressor 316 may also be diverted to charge the second tubing string 320 for future gas lift operations.

As gas is produced during the normal production mode, the accumulation of liquid in the annulus 372 may rise to a level higher than the liquid in the annulus 332. This is due to the closed position of the valve 336, which forces production fluids to flow through annulus 372.

When liquid in the annulus 372 has accumulated to a level high enough to disrupt or diminish normal gas production from the formation 309, the operation of the well 308 may be changed to the "blow down" or liquid removal mode. In the liquid removal mode, the second tubing string 320 is lowered by the lifting device 392 into the extended position. Additionally, the valve 336 is positioned in an open position to allow fluid flow. Since the extended positioning of the second tubing string 320 (i) seals the end cap 338 and (ii) allows pressurized gas from the second tubing string to enter the annulus 372, the pressurized gas injected into the annulus 372 through the ports 364 is able to "lift" the liquid that has collected in the annulus 372 to the surface 313 of the well 308, where it is separated from the gas at the separator 314. The sealing engagement of the second tubing string 320 and the end cap 338 isolates the pressurized lift gas from the annulus 332. At the surface, the check valve 340 prevents pressurized gas that may exit the separator from back flowing into the annulus 332.

Isolation of lift gas from annulus 332 may be particularly beneficial whenever a gas lift operation is installed in the horizontal section of a well. In such horizontal applications, lacking a positive grade towards the vertical section of the well, injected lift gas can easily flow opposite the desired direction. This undesired flow of lift gas into the horizontal well will consume large quantities of lift gas and ultimately cause the gas lift event to occur at a higher pressure. This higher pressure may exceed the reservoir pressure, thus allowing lift gas to flow into the reservoir producing formation. Additionally, the lift chamber that is created by the positive acting seal provides isolation greater than that available by using other sealing mechanisms, such as check valves. This positive acting seal also has clear advantages in applications where solids in the liquid may prevent an effective check valve seal.

When the well 308 is operated in the liquid removal mode, normal production of gas from the formation 309 is allowed to proceed through the annulus 332 and into the compressor 316. At the compressor 316, the gas may be pressurized for delivery to the production conduit 398. A portion of the gas exiting the compressor 316 may also be diverted to charge the second tubing string 320 for either the ongoing or future gas lift operations.

In another embodiment, valve 336 may be omitted, thus causing liquid levels in annulus 33 and annulus 372 to rise in conjunction with one another. As such, when the well 308 is operated in the normal production mode, production of gas from the formation 309 is allowed to flow through both the annulus 332 and annulus 373, then into the compressor 316. Such a configuration might be particularly applicable in a vertical well application where the gas lift mechanism is installed in a sump or rat-hole, below the producing horizon.

Referring to FIGS. 5-8, a downhole valve 506 is configured to be used with a gas lift system similar to the downhole valve 380 of FIGS. 2 and 3. Downhole valve 506 also is associated with a first tubing string 510 and a second tubing string 520. The second tubing string 520 is positioned within the first tubing string 510 and, in contrast to the previously described axial movement, is configured to rotate between a first position and a second position. Shoulders 524 positioned on an external surface of the second tubing string 520 engage stops 528 positioned on an internal surface of the first tubing string 510 to limit the rotational movement of the second tubing string 520 and to define the first and second positions.

An aperture 532 is disposed in an end of the first tubing string 510 similar to the aperture associated with first tubing string 310. A sealing member 536 such as, for example, one or more o-rings is positioned within the aperture 532 to seal against the second tubing string 520, which is received by the aperture 532. A first port 540, or alternatively a first plurality of ports, is provided in an end of the second tubing string 520 downhole of the aperture 532. The first port 540 is in fluid communication with a first inner passage 544 of the second tubing string 520. A second port 550, or alternatively a second plurality of ports, is positioned on the second tubing string 520 in fluid communication with the first inner passage 544 of the second tubing string 520. The first and second ports 540, 550 are disposed on opposite sides of the aperture 532 and are both substantially open when the second tubing string 520 is positioned in the first position (see FIG. 5). When the first and second ports 540, 550 are substantially open, fluid communication is provided between the wellbore and an annulus 554 between the first tubing string 510 and the second tubing string 520. This fluid communication allows production fluids to enter the annulus 554 during a normal production mode of the well.

Figure 5:
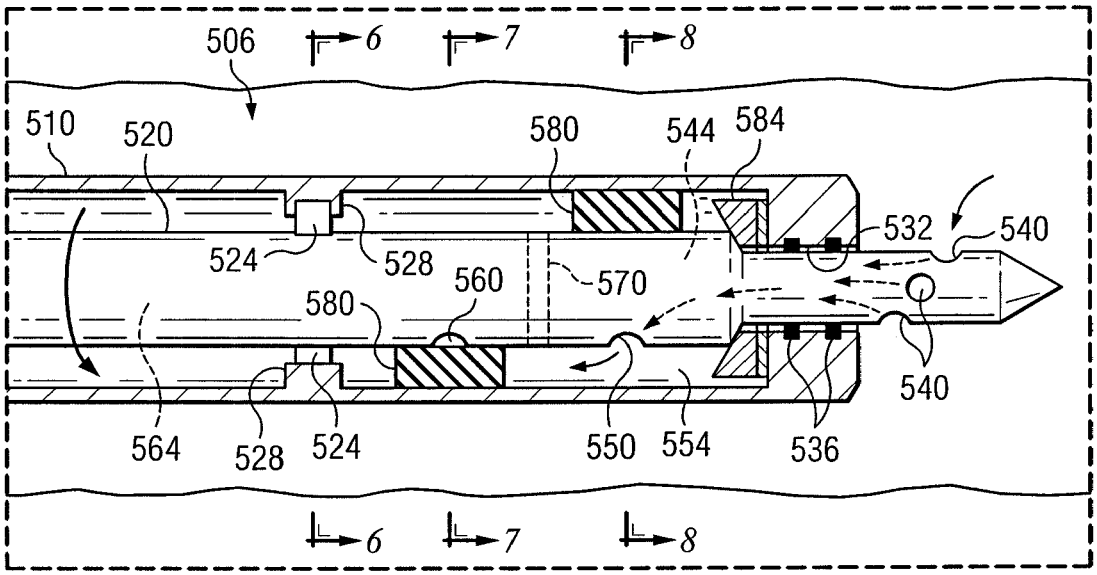
FIG. 5 illustrates a front schematic view of a downhole valve that may be used with the gas lift system of FIG. 1 according to an illustrative embodiment, the downhole valve having a second tubing string rotatable within a first tubing string to selectively operate the downhole valve.
Figure 6:
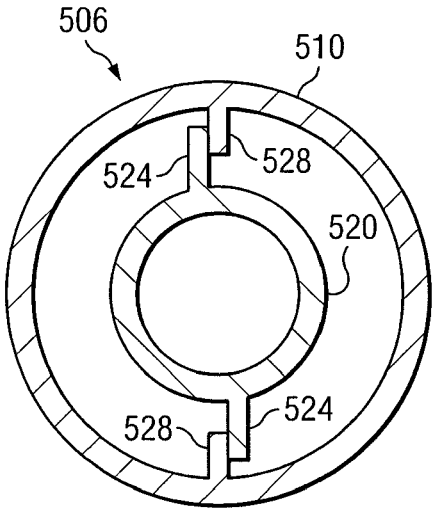
FIG. 6 depicts a cross-sectional side view of a portion of the downhole valve of FIG. 5 taken at 6-6.

In the embodiment illustrated in FIG. 5, the second port 550 is configured to be substantially blocked when the second tubing string 520 is in the second position. Alternatively, the first port 540 or both of the first and second ports 540, 550 may be substantially blocked when the second tubing string 520 is in the second position. When the first and/or second ports 540, 550 are substantially blocked, fluid communication between the wellbore and the annulus 554 is substantially inhibited or prevented.

A third port 560, or alternatively a third plurality of ports, is positioned on the second tubing string 520 in fluid communication with a second inner passage 564 of the second tubing string 520. The third port 560 is substantially blocked when the second tubing string 520 is in the first position, and the third port 560 is substantially open when the second tubing string 520 is in the second position. When the third port 560 is substantially open, fluid communication is permitted between the annulus 554 and the second inner passage 564. This fluid communication allows lift gas to remove downhole liquids during a blow down mode of the well.

Figure 7:
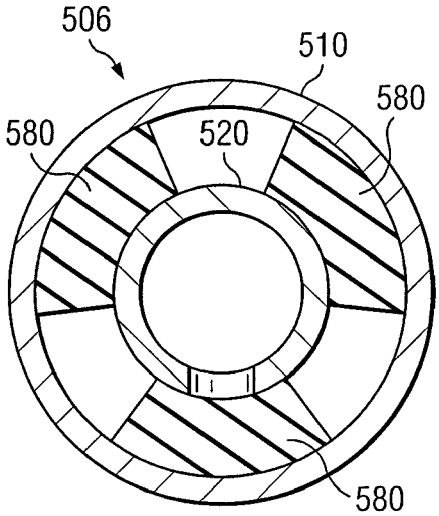
FIG. 7 illustrates a cross-sectional side view of a portion of the downhole valve of FIG. 5 taken at 7-7.
Figure 8:
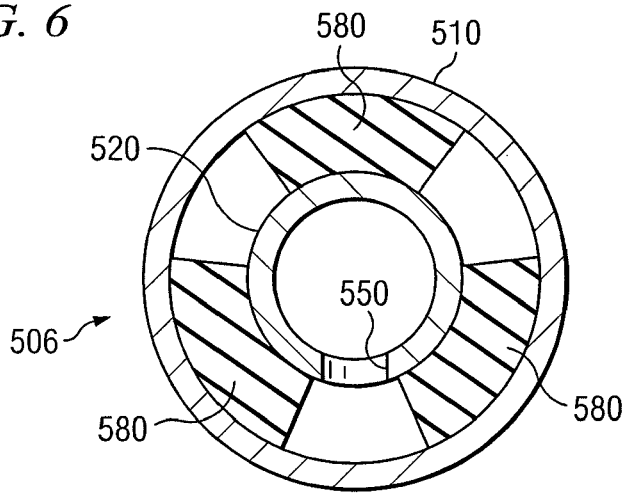
FIG. 8 depicts a cross-sectional side view of a portion of the downhole valve of FIG. 5 taken at 8-8.
Figure 9:
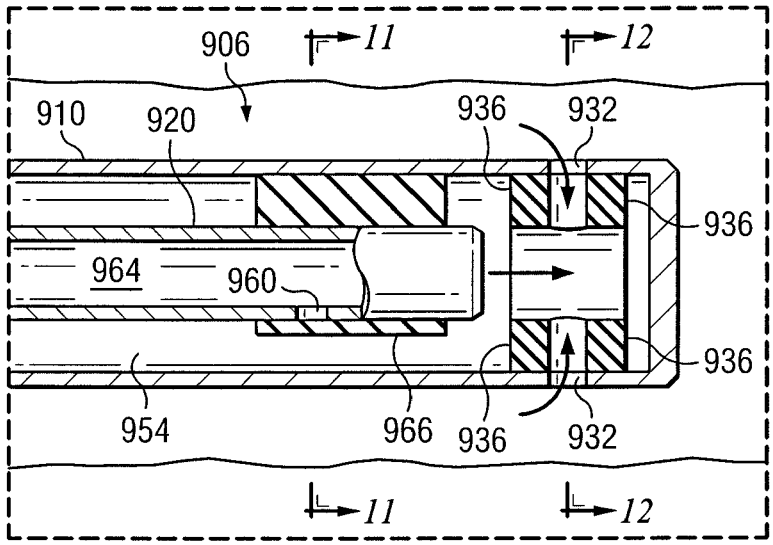
FIG. 9 illustrates a front view of a downhole valve that may be used with the gas lift system of FIG. 1 according to an illustrative embodiment, the downhole valve having a second tubing string positioned within a first position.
Figure 10:
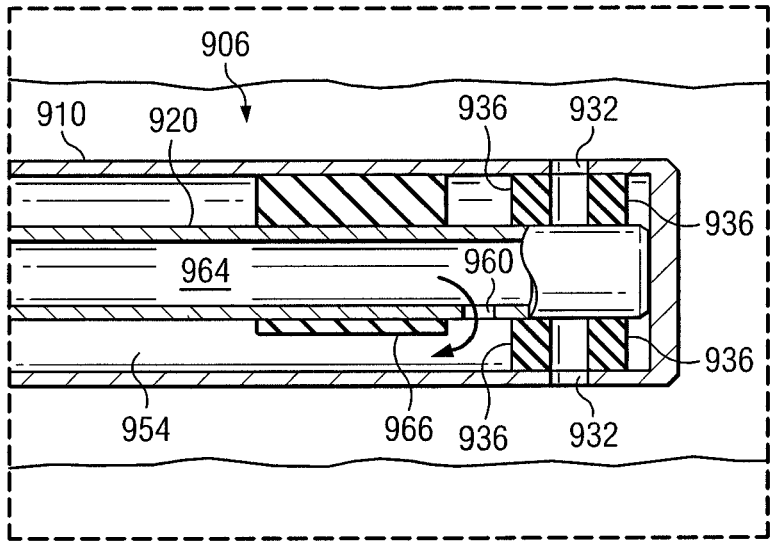
FIG. 10 depicts a front view of the downhole valve of FIG. 9 with the second tubing string positioned within a second position.
Figure 11:
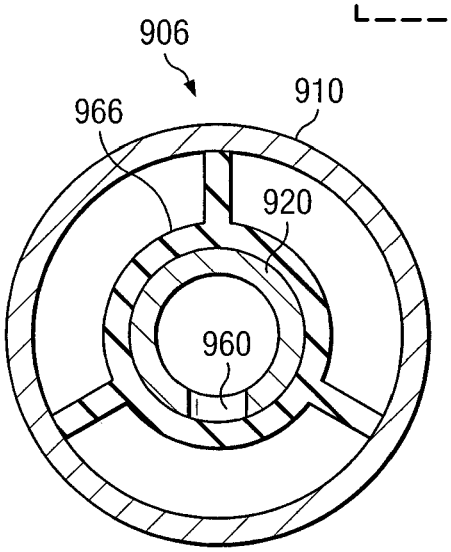
FIG. 11 illustrates a cross-sectional side view of a portion of the downhole valve of FIG. 9 taken at 11-11.
Figure 12:
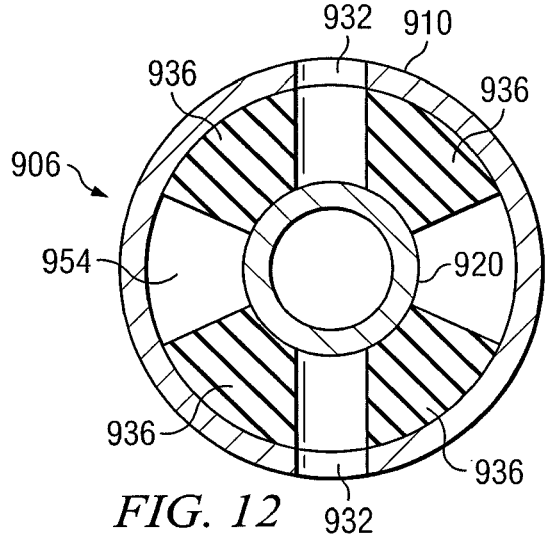
FIG. 12 depicts a cross-sectional side view of a portion of the downhole valve of FIG. 9 taken at 12-12.

Referring still to FIG. 5, but more specifically to FIGS. 7 and 8, sealing blocks 580 are positioned on or adjacent to an inner wall of the first tubing string 510 to substantially block the second and third ports 550, 560 as described above. The sealing blocks 580 may be made from an elastomeric material such as a hard rubber or any other material that has suitable wear properties and is capable of providing a seal against ports on the second tubing string 520.

Referring more specifically to FIG. 5, the second inner passage 564 is fluidly separated from the first inner passage 544 by a barrier member 570. Barrier member 570 may be a metal disk or any other suitable barrier that is welded or otherwise secured or positioned within the second tubing string 520 to substantially inhibit or prevent fluid communication between the second inner passage 564 and the first inner passage 544. In one embodiment, the second inner passage 564 is fluidly connected to a source of lift gas such that the lift gas may be delivered through the second inner passage 564 to the annulus 554 to lift liquids in the annulus 554 to the surface of the well. Alternatively, the lift gas may be delivered through the annulus 554 to the second inner passage 564 to lift and transport the liquids to the surface through the second inner passage 564.

One primary difference between the downhole valve 380 and the downhole valve 510 is that the downhole valve 510 is operated by rotating the second tubing string 520 as opposed to imparting axial movement to the second tubing string. A rotator (not shown) may be positioned at or beneath the wellhead of the well to rotate the second tubing string 520. The rotator would either manually or automatically rotate the tubing in order to initiate or stop a gas lift event. A thrust bearing 584 supports the weight of the second tubing string 320 against the first tubing string 310, thus allowing rotational movement with less applied torque.

In another embodiment, the second tubing string is designed to form an isolated gas lift chamber without physically passing through an aperture in the first tubing string. In such a case, with the second tubing string in a first position, production fluids could flow from the well into the tubing annulus between the first tubing string and the second tubing string. The fluids may enter the tubing annulus through a port positioned in a side wall of the first tubing string. Upon movement of the second tubing string to a second position, whether such movement is axial or rotational, a seal would be formed thereby blocking flow of production fluids into the tubing annulus, as well as blocking the flow of lift gas from the tubing annulus into the well.

Referring to FIGS. 9-12, a downhole valve 906 is configured to be used with a gas lift system similar to the use of downhole valves 380, 506 of FIGS. 2 and 5. Downhole valve 906 is associated with a first tubing string 910 and a second tubing string 920. In the embodiment illustrated in FIGS. 9 and 10, the second tubing string 920 is positioned within the first tubing string 910 and is configured to axially move between a first position (see FIG. 9) and a second position (see FIG. 10). Cooperative shoulders and flanges (not shown) may be provided on the first and second tubing strings 910, 920 to limit the axial movement of the second tubing string 920 and to define the first and second positions.

A port 932, or a plurality of ports, or an aperture, is disposed in a side wall of the first tubing string 910 near a downhole end of the first tubing string 910. Alternatively, the port 932 may be positioned at any location along the first tubing string 910. The port 932 is similar in function to the aperture 532 of FIG. 5 in that the port 932 is capable of allowing fluid communication between the wellbore and an annulus 954 between the first and second tubing strings 910, 920. Such fluid communication is permitted when the second tubing string 920 is placed in the first position during a normal production mode of the well. In contrast to the aperture 532, the port 932 does not receive or surround the second tubing string 920 in either of the first and second positions.

A sealing member such as, for example, a plurality of sealing blocks 936 are operatively positioned around the ports 932 to seal against the second tubing string 920 when the second tubing string 920 is in the second position. In the second position, the well is in a blow down mode and fluid communication through the ports 932 is substantially inhibited or prevented. The sealing blocks 936 may be formed of an elastomer or any other material that is suitable for sealing against the second tubing string 920.

A port 960, or alternatively a plurality of ports, is positioned on the second tubing string 920 in fluid communication with an inner passage 964 of the second tubing string 920. A sleeve 966 is positioned within the first tubing string 910 and around a portion of the second tubing string 920. The sleeve 966 may be made from an elastomeric material such as a hard rubber or any other material that has suitable wear properties and is capable of providing a seal against port 960 on the second tubing string 920. The sleeve 966 acts as a sealing member to substantially inhibit or prevent fluid communication through the port 960 when the second tubing string 920 is in the first position. During this normal production mode, fluid communication between the inner passage 964 and the annulus 954 is substantially inhibited or prevented. When the second tubing string 920 is axially moved into the second position, the sleeve 966 no longer covers the port 960, and fluid communication is permitted through the open port 960. This fluid communication allows lift gas to remove downhole liquids during the blow down mode of the well. In one embodiment, the inner passage 964 is fluidly connected to a source of lift gas such that the lift gas may be delivered through the inner passage 964 to the annulus 954 to lift liquids in the annulus 954 to the surface of the well. Alternatively, the lift gas may delivered through the annulus 954 to the inner passage 964 to lift and transport the liquids to the surface through the inner passage 964.

The downhole valve 906 selectively controls two fluid flow paths based on axial movements of the second tubing string 920. In another embodiment, the downhole valve 906 could easily be adapted to provide similar fluid control in response to rotational movement of the second tubing string 920 similar to the rotational movement used to operate downhole valve 506.

It should be appreciated by a person of ordinary skill in the art that the improved gas lift device may be used in horizontal or vertical portions of a wellbore, or alternatively in portions of a wellbore having any particular angular orientation. The system may further be used in cased or uncased portions of the wellbore. The term tubing can mean production tubing, casing, liners, or conduits. Additionally, the gas-lift system is not limited to use with only gas-producing wells, but may be used in any type of well, including wells for producing oil or any other type of gas, liquid, or other subterranean deposit. Similarly, the gas-lift system may be used to remove liquid from any type of subterranean or above-ground conduit or bore (i.e. not just wells) in which there is a desire to isolate a point of gas injection for liquid-removal purposes. Numerous control and automation processes may be employed in conjunction with the gas-lift process described herein.

It should be apparent from the foregoing that an invention having significant advantages has been provided. While the invention is shown in only a few of its forms, it is not just limited but is susceptible to various changes and modifications without departing from the spirit thereof.

I claim:

1. A gas lift system for removing liquid from a wellbore, the system comprising:

a first tubing string positioned within the wellbore;

a second tubing string disposed within the first tubing string, the second tubing string movable between a first position and a second position, an annulus being present between the second tubing string and the first tubing string;

an aperture positioned in the first tubing string;

a sleeve slidingly disposed around a portion of the second tubing string;

a port disposed in a wall of the second tubing string such that the port is substantially covered by the sleeve in the first position and is substantially uncovered in the second position to permit fluid communication between an inner passage of the second tubing string and the annulus; and a sealing member operatively associated with the aperture to allow fluid communication between the wellbore and the annulus when the second tubing string is in the first position, the sealing member substantially inhibiting fluid communication through the aperture when the second tubing string is in the second position.

2. The system of claim 1, wherein the aperture passes through an end cap in the first tubing string.

3. The system of claim 1, wherein the aperture is disposed in a side wall of the first tubing string.

4. The system of claim 1, wherein the second tubing string is axially movable.

5. The system of claim 1, wherein the second tubing string is rotationally movable.

6. The system of claim 1, further comprising:

a first flange disposed on the second tubing string;

a second flange disposed on the second tubing string; and wherein the sleeve is disposed around the second tubing string between the first flange and the second flange within the first tubing string.

7. The system of claim 1, further comprising:

a first flange disposed on the second tubing string;

a second flange disposed on the second tubing string;

a shoulder disposed on an inner wall of the first tubing string and adapted to engage the sleeve when the second tubing string is in the second position; and a spring member operatively disposed on the second tubing spring between the sleeve and the first flange.

8. The system of claim 7, wherein the spring member biases the sleeve toward the second flange in an uncompressed position.

9. The system of claim 7, wherein the spring member is substantially compressed when the second tubing string is in the second position.

10. The system of claim 1, wherein the sleeve comprises a substantial cylindrical portion and extension portions extending radially outward from an outer surface of the central portion.

11. The system of claim 1, wherein an end of the second tubing string is sealed.

12. The system of claim 1, wherein the sealing member is one of an o-ring and a sealing block.

13. The system of claim 1, further comprising:

a lifting device connected to the second tubing string;

a compressor having an inlet and an outlet, the outlet fluidly connected to the second tubing string; and a separator fluidly connected between the inlet of the compressor and the annulus.

14. A gas lift system for removing liquid from a wellbore, the system comprising:

a first tubing positioned within the wellbore, the first tubing string being fluidly connected to a separator;

a second tubing string disposed within the first tubing string, the second tubing string being operatively connected to a lifting device to move the second tubing string between a first position and a second position, the second tubing string having an inner passage fluidly connected to an outlet of a compressor;

an aperture positioned near an end of the first tubing string, the aperture being adapted to receive an end of the second tubing string in the second position;

a first flange disposed on the second tubing string;

a second flange disposed on the second tubing string;

a sleeve slidingly disposed around the second tubing string between the first flange and the second flange within the first tubing string;

an outlet disposed in a wall of the second tubing string such that the outlet is closed by the sleeve in the first position and is open in the second position to permit fluid communication between the inner passage of the second tubing string and a first annulus between the first tubing string and the second tubing string; and a sealing member for creating a seal between the aperture in the first tubing string and the end of the second tubing string in the second position.

15. The system of claim 14, wherein a second annulus is present between the first tubing string and the wellbore.

16. The system of claim 15, wherein the second annulus is fluidly connected to an inlet of a compressor.

17. The system of claim 16, further comprising a valve fluidly connected between the second annulus and the inlet of the compressor to selectively control fluid flow within the second annulus.

18. The system of claim 14, wherein the lifting device is a hydraulic lifting device.

19. A gas lift system for removing liquid from a wellbore, the system comprising:

a first tubing string positioned within the wellbore;

a second tubing string disposed within the first tubing string, the second tubing string having an inner passage and being movable between a first position and a second position, an annulus being present between the second tubing string and the first tubing string;

an aperture disposed in the first tubing string to permit fluid communication between the wellbore and the annulus when the second tubing string is in the first position; and a port disposed in the second tubing string to permit fluid communication between the inner passage and the annulus when the second tubing string is in the second position.

20. The system of claim 19, wherein the aperture is disposed in an end cap of the first tubing string.

21. The system of claim 19, wherein the aperture is disposed in a side wall of the first tubing string.

22. The system of claim 19, wherein the second tubing string is axially movable.

23. The system of claim 19, wherein the second tubing string is rotationally movable.

24. The system of claim 19, wherein fluid communication through the aperture is substantially inhibited when the second tubing string is in the second position.

25. The system of claim 19, wherein fluid communication through the port is substantially inhibited when the second tubing string is in the first position.

26. The system of claim 19 further comprising:

a gas source fluidly connected to one of the first tubing string and the second tubing string.

* * * * *